US008939669B2

(12) United States Patent
Le et al.

(10) Patent No.: US 8,939,669 B2
(45) Date of Patent: Jan. 27, 2015

(54) ROLLER-BALL APPLICATOR ASSEMBLY FOR TOPICAL OILS APPLICATION

(75) Inventors: Son Q. Le, Highland, UT (US); Cole Woolley, Orem, UT (US); Marc Schreuder, Provo, UT (US); John Whetten, Lindon, UT (US)

(73) Assignee: Young Living Essential Oils, LC, Lehi, UT (US)

( * ) Notice: Subject to any disclaimer, the term of this patent is extended or adjusted under 35 U.S.C. 154(b) by 297 days.

(21) Appl. No.: 13/231,916

(22) Filed: Sep. 13, 2011

(65) Prior Publication Data

US 2013/0064596 A1 Mar. 14, 2013

(51) Int. Cl.
*B43K 7/10* (2006.01)
*A45D 34/04* (2006.01)

(52) U.S. Cl.
CPC ..... *A45D 34/04* (2013.01); *A45D 34/041* (2013.01)
USPC ..... 401/216; 401/213

(58) Field of Classification Search
CPC ..... A45D 34/04; A45D 34/041; A45D 33/12; A45D 40/26; A45D 40/261; B05C 1/08; B43K 7/00; B43M 11/085
USPC ..... 401/208, 213, 214, 216
See application file for complete search history.

(56) References Cited

U.S. PATENT DOCUMENTS

| | | | | |
|---|---|---|---|---|
| 2,923,957 | A | 2/1960 | Gentile | |
| 2,937,392 | A | 3/1960 | Williams | |
| 4,270,526 | A | 6/1981 | Morales et al. | |
| 4,571,106 | A | 2/1986 | Scuderi | |
| 5,131,384 | A | 7/1992 | Obagi | |
| 5,553,957 | A * | 9/1996 | Dornbusch et al. | 401/209 |
| 7,117,818 | B2 | 10/2006 | Pappas et al. | |
| 7,293,930 | B2 * | 11/2007 | Chuang | 401/216 |
| 7,311,462 | B2 * | 12/2007 | Kervoalen | 401/216 |
| 7,674,061 | B2 | 3/2010 | Baines et al. | |
| 2005/0249540 | A1 | 11/2005 | Gueret | |
| 2006/0018702 | A1 | 1/2006 | Silva | |
| 2006/0018704 | A1 | 1/2006 | Baines et al. | |
| 2006/0222445 | A1 | 10/2006 | Chuang | |
| 2006/0287616 | A1 | 12/2006 | Nan | |

FOREIGN PATENT DOCUMENTS

| | | |
|---|---|---|
| KR | 2000228675 | 8/2001 |
| WO | 00/70995 | 11/2000 |
| WO | 2011003211 | 1/2011 |

OTHER PUBLICATIONS

U.S. Appl. No. 13/425,072, 3324.2.YL08, 19517.08, Office Action, Jun. 17, 2014.

PCT/US2012/020207, YL5pct, 3324.2.YL5pct, International Preliminary Report on Patentability, Mar. 18, 2014.

(Continued)

*Primary Examiner* — David Walczak
(74) *Attorney, Agent, or Firm* — Kunzler Law Group, PC

(57) ABSTRACT

Applicator devices for applying topical oils to an individual are presented. Exemplary applicators may include a topical oil container, and a roller-ball applicator coupled to the container. The roller-ball applicator may include, a roller-ball housing, wherein the roller-ball housing includes a well configured to hold topical oil for application to an individual regardless of the orientation of the roller-ball applicator, and a roller-ball within the housing, the roller-ball being freely rotatable within the housing.

26 Claims, 3 Drawing Sheets

(56) References Cited

OTHER PUBLICATIONS

PCT/US2012/020207, YL5pct, 3324.2.YL5pct, International Search Report, Sep. 27, 2012.

PCT/US2012/020207, YL5pct, 3324.2.YL5pct, Written Opinion, Sep. 27, 2012.

PCT/US2012/029943, YL17PCT, 3324.2.17PCT, International Search Report, Feb. 28, 2013.

* cited by examiner

ROLLER-BALL APPLICATOR ASSEMBLY FOR TOPICAL OILS APPLICATION

FIELD

This application relates generally to roller ball applicators. In particular, this application relates to roller ball applicators for applying topical oils to an individual.

BACKGROUND

In recent years, sales for essential oils and other topically applied oils have exploded. Topically applied oils are usually oils which are derived from, or include certain essential components or essences of different substances. Such topically applied oils are generally referred to as essential oils.

Essential oils, known as nature's living energy, are the natural, aromatic volatile liquids found in shrubs, flowers, trees, resins, fruit peels, rhizomes, roots, bushes, and seeds. The distinctive components in essential oils defend plants against sects, environmental conditions, and disease. They are also vital for a plant to grow, live, evolve, and adapt to its surroundings. Essential oils are extracted from aromatic plant sources via steam distillation, cold pressing, and other types of distillation. Essential oils are highly concentrated and far more potent than dry herbs. Other topically applied oils may include olive oil, almond oil, coconut oil, etc. and oils high in esters, such as jojoba oil, and waxes such as beeswax.

While essential oils often have a pleasant aroma, their chemical makeup is complex and their benefits vast—which makes them much more than something that simply smells good. Historically, essential oils have played a prominent role in everyday life. With more than 200 references to aromatics, incense, and ointments throughout the Bible, essential oils are said to be used for anointing and healing the sick. Today, essential oils are used for aromatherapy, massage therapy, emotional health, personal care, nutritional supplements, household solutions, and much more.

Roller-ball applicators have been used in many applications. However, roller-ball applicators generally use a fairly pliable plastic housing to accommodate the ball in a press-fit assembly. Traditional roller-ball assemblies are unsuitable for use with most topical oils, such as essential oils, particularly citrus essential oils, and other similar oils with potent chemical solvents, because the oils tend to impregnate plastics and relax the elasticity, which often causes the roller-ball to become excessively loose and potentially dislodge. Additionally, essential oils tend to work as solvents with plastics and can leach unwanted chemicals and compounds from the plastics into the essential oils. Because of this, applicators for topical oils use different application methods and devices that do not require plastics that retain their material properties, and when using essential oils, avoid plastics altogether.

SUMMARY

Applicator devices for applying topical oils to an individual are disclosed herein. The applicator devices overcome the deficiencies in the prior art by allowing topical oils, especially essential oils, to be applied using a roller-ball applicator. Exemplary applicators may include a topical oil container, and a roller-ball applicator coupled to the container. The roller-ball applicator may include, a roller-ball housing, wherein the roller-ball housing includes a well configured to hold topical oil for application to an individual regardless of the orientation of the roller-ball applicator, and a roller-ball within the housing, the roller-ball being freely rotatable within the housing. The applicator device may also include a cap configured to be removably attached to the container and to seal topical oil within the topical oil container by exerting pressure on the roller-ball when the cap is securely attached to the container.

In some embodiments, the topical oil may be an essential oil, and the roller-ball housing may be formed from a homopolymer polypropylene. The well may have a volume of at least 0.3 ml. The roller-ball may be formed from metal, glass, or homopolymer polypropylene. Similarly, the topical oil container is formed from glass.

Topical oils may be applied to an individual using an exemplary applicator by placing topical oil in a container, coupling a roller-ball assembly to the container, placing a roller-ball of the roller-ball assembly against the skin of an individual, and moving the roller-ball assembly such that the roller-ball rotates within the roller-ball assembly and delivers oil to the skin of the individual.

BRIEF DESCRIPTION OF THE DRAWINGS

The following description can be better understood in light of Figures, in which:

FIG. 2 illustrates a cross-sectional view of an exemplary roller-ball topical oil applicator and bottle with a cap on.

Figure 1A:
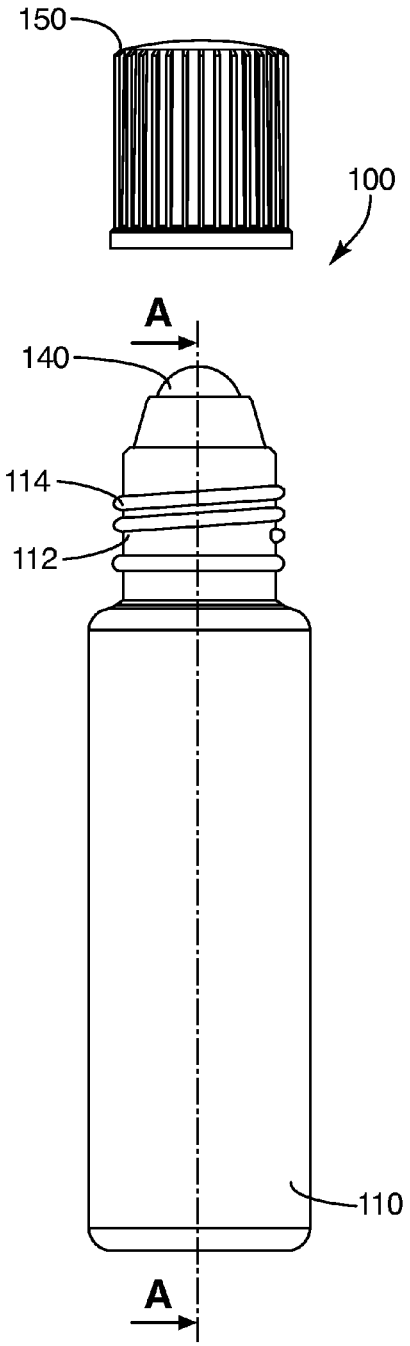
FIGS. 1*a*-1*b* illustrate an exemplary roller-ball topical oil applicator and bottle.

Together with the following description, the Figures demonstrate and explain the principles of roller-ball topical oil applicators and methods for making and using the roller-ball topical oil applicator. In the Figures, the thickness and configuration of components may be exaggerated for clarity. The same reference numerals in different Figures represent the same component.

DETAILED DESCRIPTION

The following description supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques conventionally used in the industry. For example, while the description below focuses on roller ball applicators used with glass bottles, other types of bottles and containers may be used.

Figure 1B:
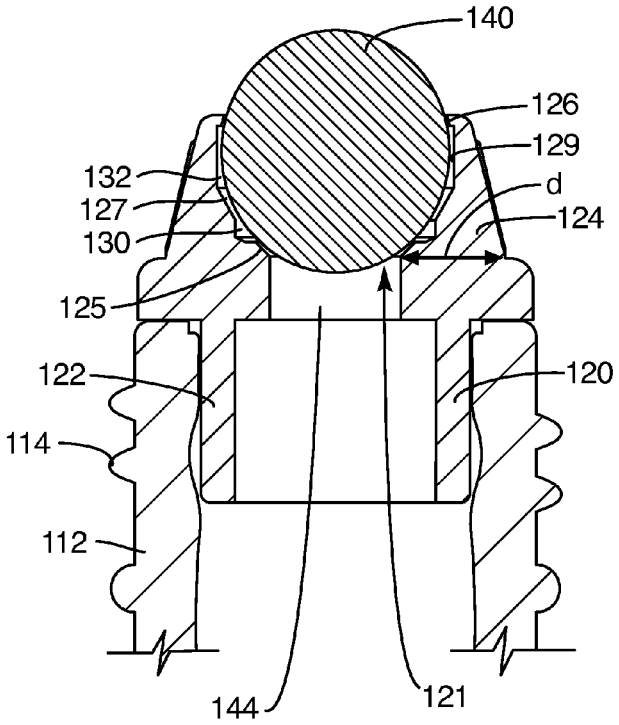
Figure 2:
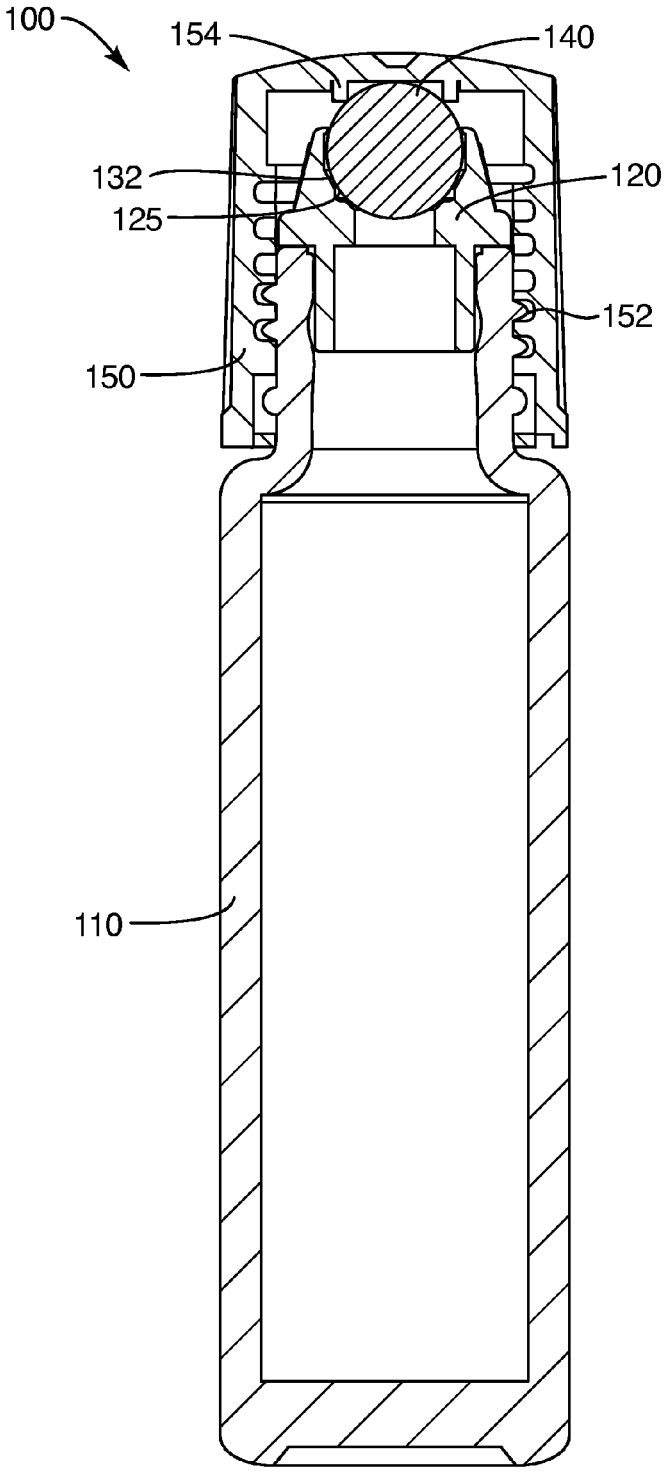

FIGS. 1*a*-2 illustrate roller-ball topical oil applicator 100, which may be used for storing and applying topical oils, such as essential oils to the skin of an individual. Applicator 100 may include bottle 110, applicator body 120, roller-ball 140, and cap 150. Bottle 110 may be formed of glass or other suitable container for transporting and containing topical oils such as essential oils. Bottle 110 may include neck 112 and threads 114 on neck 112 to accommodate applicator body 120 and cap 150. In some embodiments, neck insert 122 of applicator body 120 may be of a complimentary size to the internal dimensions of neck 112 to provide an appropriate fitment between bottle 110 and applicator body 120 for a tight fit without leakage. Neck insert 122 may include retention rings 128 to provide increased fit with neck 112 of bottle 110, to prevent oils from seeping out of bottle 110 between neck 112 and neck insert 122.

Figure 3A:
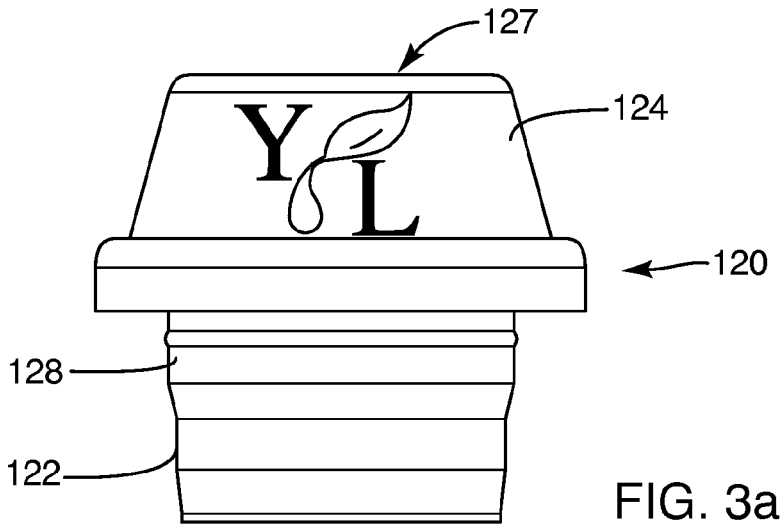
FIGS. 3*a*-3*b* illustrate a roller-ball applicator body for an exemplary roller-ball topical oil applicator.
Figure 3B:
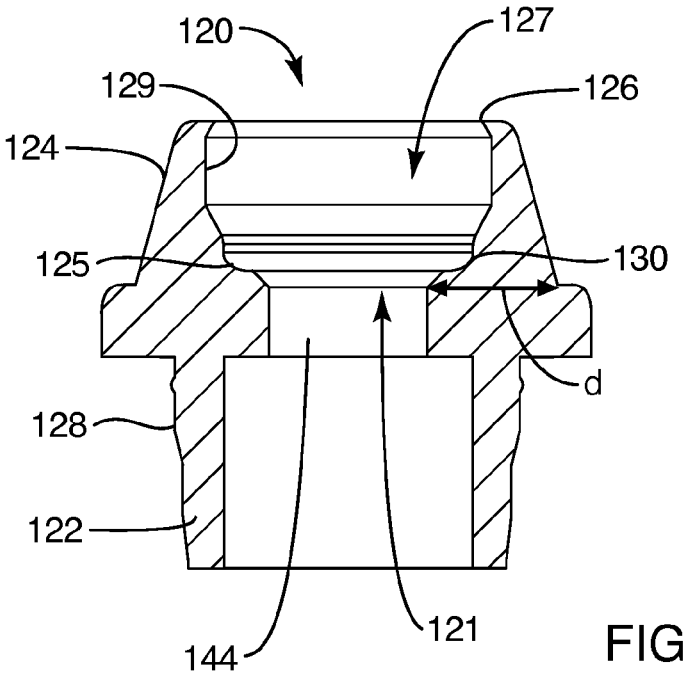

Applicator body 120 may be formed from an oil resistant plastic, metal, or other suitable material such as chemically resistant polypropylene, ultem, other homopolymers, etc. For example, a homopolymer polypropylene may be suitable in proper dimensions to maintain sufficient material strength and elasticity to hold roller-ball 140 in place and function as designed for many, many applications. Applicator body 120 may include neck insert 122, sized appropriately to interface with bottle 110, or other suitable container. Applicator body 120 may also include roller-ball housing 124 for holding and working in conjunction with roller-ball 140 to apply a desired amount of topical oil. As shown in FIGS. 1*b* and 3*b*, the roller-ball housing 124 has an inner cavity adapted to hold the roller-ball 140.

Roller-ball housing 124 includes ball retainer lip 126, which has an annular diameter dimension smaller than the diameter of roller-ball 140 to secure roller-ball 140 in place. Roller-ball 140 may be placed in roller-ball housing by forcing roller-ball 140 through the opening formed by retainer lip 126. As such, retainer lip is formed of a material that allows for elastic deformation to admit roller-ball 140 while returning to a smaller size to hold roller-ball 140 within roller-ball housing 124.

Roller-ball housing 124 is dimensioned such that even with some impregnation by oils, applicator body 120 generally holds its shape and is able to function as designed. For example, in FIGS. 3*a* and 3*b*, applicator body is shown in detail. Dimension "d" is shown as several times thicker than the thickness of roller ball housing 124 near ball retainer lip 126; "d" may be at least 2.0 mm and may be as large as practical for the applicator to extend the useful life of topical oil roll-on applicator 100. Particularly, essential oils with solvents, such as citrus oils, tend to affect plastics in an aggressive manner. Having increasing "d" may provide additional life to roller-ball housing 124.

Roller-ball housing 124 may include an annular well 130 formed on the inner surface 129 of the inner cavity 127 of the roller-ball housing 124 and that holds topical oil for delivery to an individual using applicator 100. Well 130 may be replenished by tipping applicator 100 with roller-ball 140 downward, which then pulls roller-ball 140 into contact with retainer lip 126, preventing the topical oil from flowing out, but allowing the oil to flow into space 132 and well 130. Space 132 may be about 0.182 wide between roller-ball housing 124 and roller-ball 140, extending from retainer lip 126 to lower seat 125. Thus, as shown in FIGS. 1*b* and 3*b*, the inner surface 129 of the inner cavity 127 can approximate the exterior shape of the roller-ball 140. When applicator 100 is in an upright position, roller-ball 140 is in contact with lower seat 125 by gravity pulling down on roller-ball 140 against lower seat 125. Similarly, when applicator 100 is in an overturned position, roller-ball 140 is in contact with retainer lip 126, preventing the topical oil from flowing out.

When roller-ball 140 is rotated, an amount of the oil coats the exterior surface of roller-ball 140 and may then be deposited on the skin of an individual using applicator 100 by rolling roller-ball 140 along their skin. Applicator 100 may work in any orientation to deliver oil to the skin of a user in part because well 130 holds oils to coat roller-ball 140 even when applicator 100 is oriented such that oil is not contacting roller ball 140 through channel 144. Typically, a single topical oil application will deliver about 0.3 ml at each application. To apply in an overturned position, a pressure may be applied to roller-ball 140 as it contacts against the skin to which topical oils are to be applied, which may allow oils to flow between retainer lip 126 and roller-ball 140. To apply in an upright position, roller-ball 140 collects oils from well 130 and space 132, and since roller-ball 140 is generally positioned against lower seat 125, the oil is able to be delivered without being scraped off by retainer ring 126.

Because roller-ball 140 may have some play between contact with lower seat 125 in one position and contact with retainer lip 126 in the other, oil may be retained in well 130 and space 132 to deliver to a user in any orientation, even after applicator has been in an upright position for some time. For example, when cap 150 is in position, such as can be seen in FIG. 2, cap ring 154 may press down on roller-ball 140, which in turn presses down against lower seat 125, effectively trapping any oils remaining in well 130 and space 132 for delivery when cap 150 is removed as desired.

Applicator 100 may be formed in any size suitable for delivery of topical oils, such as essential oils. The various components of applicator 100 may be sized accordingly, however, space 132 and well 130 may be designed and spaced to provide at least 0.3 ml for a desired application amount.

In some embodiments, cap 150 may be formed to connect directly to applicator body 120, and applicator body 120 may be formed to connect to threads 114 of bottle 110. Cap 150 may include interior threads 152 that correspond with threads 114 of bottle 110, or with threads that may be included on applicator body 120. In other embodiments, cap 150 may be a snap-fit, or other type of connection, such as hinged, etc.

In addition to any previously indicated modification, numerous other variations and alternative arrangements may be devised by those skilled in the art without departing from the spirit and scope of this description, and appended claims are intended to cover such modifications and arrangements. Thus, while the information has been described above with particularity and detail in connection with what is presently deemed to be the most practical and preferred aspects, it will be apparent to those of ordinary skill in the art that numerous modifications, including, but not limited to, form, function, manner of operation and use may be made without departing from the principles and concepts set forth herein. Also, as used herein, examples are meant to be illustrative only and should not be construed to be limiting in any manner.

The invention claimed is:

1. A device for applying topical oils to an individual, the device comprising:

a roller-ball housing having an inner cavity adapted to hold a roller-ball, the inner cavity having an inner surface that approximates the exterior shape of a roller-ball, the inner surface having a substantially vertical surface when the roller-ball housing is in an upright position, the substantially vertical surface transitioning into an inwardly-slanted surface;

an annular well formed in the inner surface of the inner cavity, the inwardly-slanted surface of the inner surface of the inner cavity transitioning into an inner surface of the annular well; and a roller-ball disposed within the inner cavity of the roller-ball housing.

2. The device of claim 1, further comprising a container adapted to hold topical oil.

3. The device of claim 1, wherein the roller-ball housing is formed from a homopolymer polypropylene.

4. The device of claim 1, wherein the well has a volume of at least 0.3 ml and is adapted to hold and apply to an individual regardless of the orientation of the roller-ball applicator.

5. The device of claim 1, wherein the roller-ball is formed from metal.

6. The device of claim 2, further comprising a cap configured to be removably attached to the container and to seal the container by exerting pressure on the roller-ball when the cap is securely attached to the container.

7. A method of applying topical oil to an individual, the method comprising:

coupling a roller-ball assembly to a container of topical oil, the roller-ball assembly having an inner cavity housing a roller-ball, the inner cavity having an inner surface that approximates the exterior shape of a roller-ball, an annular well being formed in the inner surface, the inner surface having a substantially vertical surface when the roller-ball assembly is in an upright position, the substantially vertical surface transitioning into an inwardly-slanted surface, the inwardly-slanted surface transitioning into an inner surface of the annular well; and moving the roller-ball assembly such that the roller-ball rotates within the roller-ball assembly and delivers oil to the skin of the individual.

8. The method of claim 7, wherein the roller-ball assembly delivers at least 0.3 ml of topical oil when the roller-ball assembly is in any orientation.

9. The method of claim 7, wherein the topical oil is an essential oil.

10. The method of claim 7, further comprising, prior to moving the roller-ball assembly, placing the roller-ball of the roller-ball assembly in contact with the skin of the individual.

11. The method of claim 10, wherein the roller-ball housing is formed from a homopolymer polypropylene.

12. The method of claim 10, wherein the roller-ball is formed from metal.

13. The method of claim 7, wherein the roller-ball assembly includes features including a well to hold at least 0.3 ml of topical oil within the roller-ball assembly.

14. The method of claim 7, wherein the topical oil container is formed from glass.

15. The method of claim 7, wherein the topical oil is a citrus essential oil.

16. An applicator for topical oil, the apparatus comprising:

a roller-ball housing having an inner cavity adapted to hold a roller-ball, the inner cavity having an inner surface that approximates the exterior shape of a roller-ball, the inner surface having a substantially vertical surface when the roller-ball housing is in an upright position, the substantially vertical surface transitioning into an inwardly tapered section;

a well formed in the inner surface of the inner cavity, the inwardly tapered section of the inner surface of the inner cavity transitioning into an inner surface of the well; and a roller-ball disposed within the cavity of the roller-ball housing.

17. The applicator of claim 16, wherein the roller-ball housing further comprises a neck insert shaped and sized to provide a fitment between a bottle and the applicator body without leakage.

18. The applicator of claim 16, further comprising a between inner surface of the inner cavity and roller-ball, wherein the volume of the space and the well is sized to hold at least 0.3 ml of topical oil.

19. The applicator of claim 16, wherein the roller-ball is formed from metal.

20. The applicator of claim 16, further comprising a cap.

21. An applicator for topical oil, the apparatus comprising:

a roller-ball housing having an inner cavity adapted to hold a roller-ball, an inner surface of the inner cavity having a substantially vertical surface when the roller-ball housing is in an upright position, the substantially vertical surface transitioning into an inwardly slanted surface;

a well formed in the inner surface of the inner cavity; and a roller-ball disposed within the cavity of the roller-ball housing, the well formed such that an upper edge of the well does not contact the roller-ball, wherein the inwardly-slanted surface of the inner surface of the inner cavity transitions to an inner surface of the well at the upper edge of the well.

22. The applicator of claim 21, wherein the well has a volume of at least 0.3 ml and is adapted to hold and apply oil to an individual regardless of an orientation of the roller-ball applicator.

23. A topical applicator for oil, the topical applicator comprising:

a roller-ball;

a roller-ball housing having a retainer lip, a lower seat, and an inner cavity interposed therebetween, the inner cavity being configured to receive the roller-ball, the retainer lip having a diameter that is less than a maximum diameter of the roller-ball, and the lower seat having a diameter that is less than the diameter of the retainer lip, wherein, when the roller-ball housing has an upright orientation, the roller-ball is in contact with the lower seat and, when the roller-ball housing has an overturned orientation, the roller-ball is in contact with the retainer lip; and an annular well formed on an inner surface of the inner cavity, the annular well for holding an oil such that the oil is able to flow into the annular well when the roller-ball housing is in the overturned orientation and, when the roller-ball housing is in the upright orientation, the lower seat is adapted to prevent the held oil from exiting the inner cavity via the lower seat but the annular well is adapted to allow the held oil to transfer from the annular well to the outer surface of the roller-ball as the roller ball is rotated within the inner cavity.

24. The topical applicator of claim 23, wherein the annular well is shaped such that an upper edge of the annular well does not contact the roller-ball when the roller-ball housing is in the upright orientation and when the roller-ball housing is in the overturned orientation thereby allowing the held oil to transfer from the annular well to the outer surface of the roller-ball.

25. The topical applicator of claim 23, wherein the inner surface of the inner cavity has a substantially vertical surface when the roller-ball housing is in the upright position, the substantially vertical surface transitions into an inwardly-slanted surface, and the inwardly-slanted surface of the inner cavity transitions into an inner surface of the annular well.

26. The topical applicator of claim 25, further comprising a space interposed between the inner surface of the cavity and the outer surface of roller-ball, wherein the space comprises a volume of at least 0.3 ml.

* * * * *